US007810958B2

(12) United States Patent
Liu et al.

(10) Patent No.: US 7,810,958 B2
(45) **Date of Patent: *Oct. 12, 2010**

(54) OUTDOOR LED LAMP ASSEMBLY

(75) Inventors: You-Xue Liu, Shenzhen (CN); Li He, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 247 days.

This patent is subject to a terminal disclaimer.

(21) Appl. No.: 12/133,401

(22) Filed: Jun. 5, 2008

(65) Prior Publication Data

US 2009/0244927 A1 Oct. 1, 2009

(30) Foreign Application Priority Data

Mar. 26, 2008 (CN) ..... 2008 1 0066343

(51) Int. Cl.
*F21V 29/00* (2006.01)

(52) U.S. Cl. ..... 362/294; 362/218; 362/249.02; 362/249.05; 362/373

(58) Field of Classification Search ..... 362/218, 362/294, 373, 249.02, 249.05
See application file for complete search history.

(56) References Cited

U.S. PATENT DOCUMENTS

| | | | | |
|---|---|---|---|---|
| 6,787,999 | B2 * | 9/2004 | Stimac et al. | 315/51 |
| 7,293,898 | B2 * | 11/2007 | Kumthampinij et al. | 362/294 |
| 7,588,355 | B1 * | 9/2009 | Liu et al. | 362/373 |
| 7,637,637 | B2 * | 12/2009 | Liu et al. | 362/294 |
| 7,674,013 | B2 * | 3/2010 | Leslie et al. | 362/249.05 |
| 2007/0103895 | A1 * | 5/2007 | Riesebosch | 362/154 |
| 2009/0097264 | A1 * | 4/2009 | Dunn | 362/373 |

* cited by examiner

*Primary Examiner*—Stephen F Husar
*Assistant Examiner*—James W Cranson
(74) *Attorney, Agent, or Firm*—Frank R. Niranjan

(57) ABSTRACT

An outdoor LED lamp assembly includes a receiving member, a driving circuit module received in the receiving member, an LED lamp mounted on the receiving member, and a switch received in the receiving member and electronically connecting with the driving circuit module to control power off and power on of the outdoor LED lamp assembly. The receiving member includes a bottom plate. The LED lamp includes a heat sink and a plurality of LED modules mounted on the heat sink. The bottom plate depresses the switch so that the switch is at an "ON" position to enable a current to flow to the driving circuit module via the switch. When the bottom plate is removed from the receiving member, the switch is changed from the "ON" position to an "OFF" position, whereby the current cannot flow to the driving circuit module via the switch.

16 Claims, 6 Drawing Sheets

OUTDOOR LED LAMP ASSEMBLY

BACKGROUND OF THE INVENTION

1. Field of the Invention

The present invention relates to an outdoor LED lamp assembly, and more particularly to an outdoor LED lamp assembly having a built-in switch to control power on or off of the outdoor LED lamp.

2. Description of Related Art

The technology of light emitting diodes has rapidly developed in recent years from indicators to illumination applications. With the features of long-term reliability, environment friendliness and low power consumption, the LED is viewed as a promising alternative for future lighting products, such as an outdoor LED lamp assembly.

Unavoidably, a conventional outdoor LED lamp assembly needs to be repaired or maintained after a period of use. When a serviceman carries out the repair or maintenance, a switch for controlling the outdoor LED lamp assembly, which is usually located a distance away from the outdoor LED lamp assembly, is turned off to protect the serviceman from electric shock. When the repair or maintenance of the outdoor LED lamp assembly is finished, the switch controlling the outdoor LED lamp assembly is turned on to see the effectiveness of the repair or maintenance. If the effectiveness is not satisfactory, the serviceman needs to repeat the above operation, inclusive of the turn on and off of the distant switch again. It is inconvenient for the serviceman to turn on and turn off the distant switch since it may involves an up and a down movement on a ladder. Furthermore, the serviceman may forget to turn off the distant switch before the repair and maintenance; when this happens the serviceman is exposed to a danger of electric shock.

What is needed, therefore, is an outdoor LED lamp assembly having a switch located in the outdoor LED lamp self which can control power on or off of the outdoor LED lamp assembly. The switch is automatically turned off when a bottom plate of the LED lamp assembly is removed in order to proceed with the repair or maintenance of the LED lamp assembly, and turned on when the bottom plate is mounted back to the LED lamp assembly. Accordingly, a serviceman can conveniently and securely carry out the repair or maintenance of the outdoor LED lamp assembly.

SUMMARY OF THE INVENTION

An outdoor LED lamp assembly includes a receiving member, a driving circuit module received in the receiving member, an LED lamp mounted on the receiving member, and a switch received in the receiving member and electronically connecting with the driving circuit module to control power off and power on of the outdoor LED lamp assembly. The receiving member includes a bottom plate. The LED lamp includes a heat sink and a plurality of LED modules mounted on the heat sink. When the bottom plate is mounted to the receiving member, the switch is depressed by the bottom plate to be at a closed position, whereby current can flow from a power source through the switch to the driving circuit module. Alternatively, when the bottom plate is removed from the receiving member in order to carry out a repair or maintenance of the LED lamp assembly, the switch is no longer depressed by the bottom plate and is at an opened position, whereby the current from the power source is no longer able to flow from the power source to the driving circuit module via the switch.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
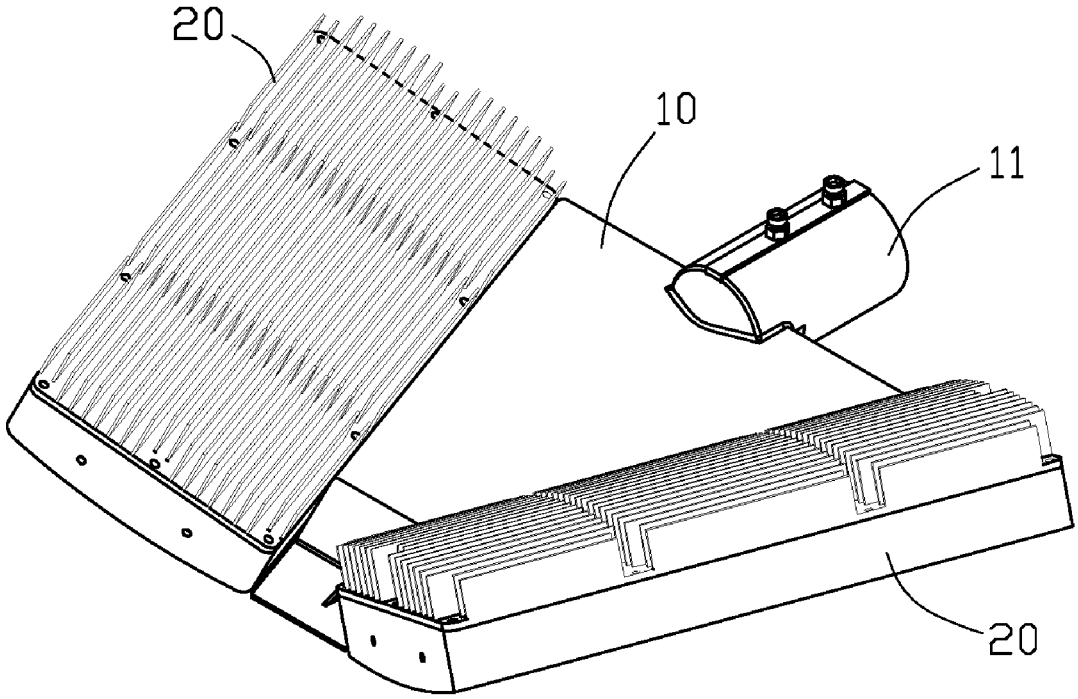
FIG. 1 is an assembled view of an outdoor LED lamp assembly in accordance with a preferred embodiment of the present invention.

Referring to FIG. 1, an outdoor LED lamp assembly (not labeled) comprises a receiving member 10 and a pair of LED lamps 20 assembled on opposite sides of the receiving member 10.

Figure 2:
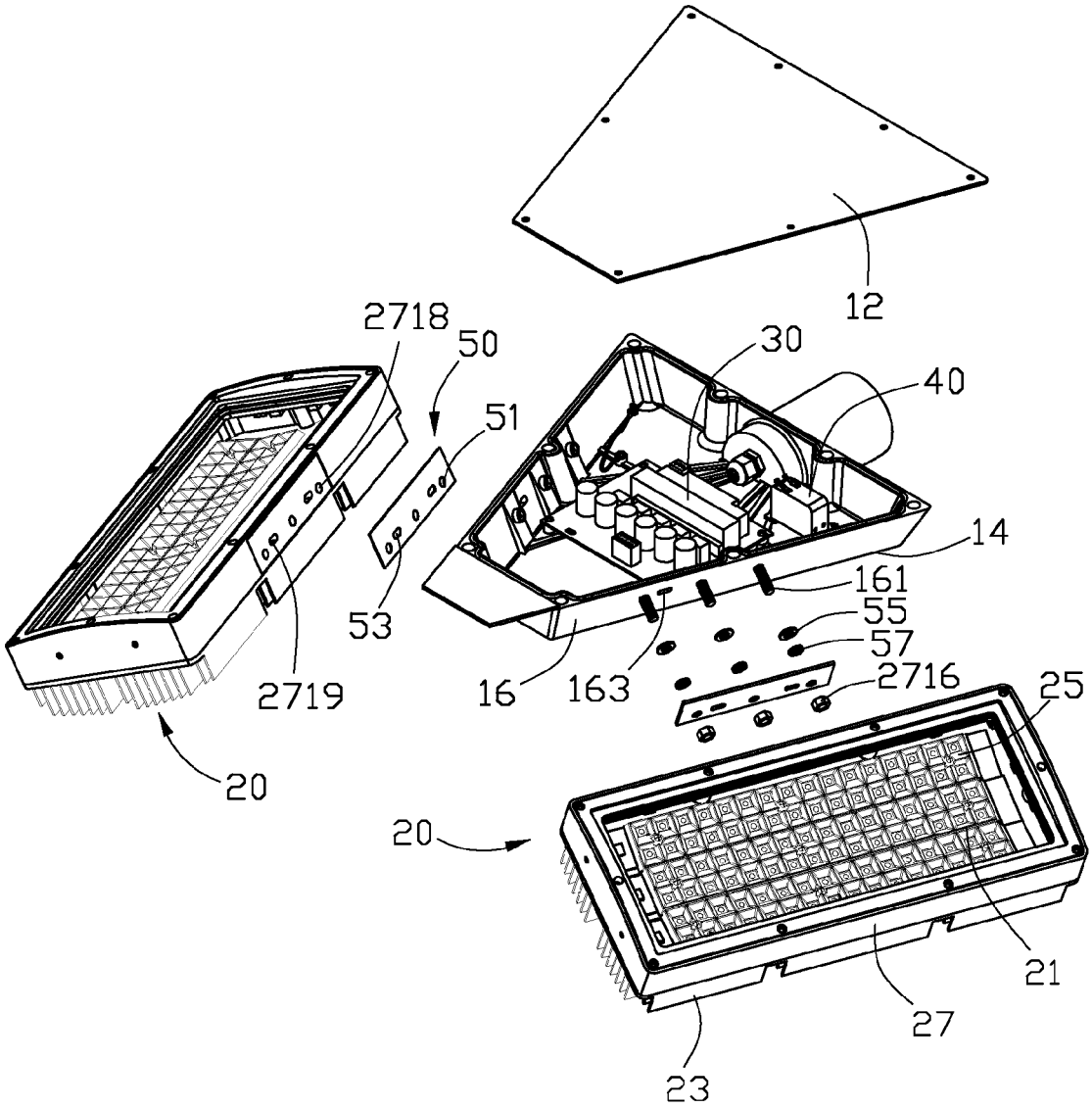
FIG. 2 is an exploded view of FIG. 1, but viewed from a different aspect.

Referring to FIG. 2, the receiving member 10 has a triangular configuration and consists of a top plate 14, a bottom plate 12 opposite to the top plate 14, a pair of mounting plates 16 connecting right and left edges of the top and bottom plates 14, 12, and a rear plate (not labeled) and a front plate (not labeled) connecting rear and front edges of the top and bottom plates 14, 12, respectively. A lamp holder 11 is secured to the rear plate of the outdoor LED lamp assembly. The lamp holder 11 is provided for securely connecting with a supporting post (not shown) whereby the outdoor LED lamp assembly can be supported by the supporting post. The bottom plate 12 and the top plate 14 are trapeziform and parallel to each other. The bottom plate 12 has a slightly larger area than that of the top plate 14; thus, the mounting plates 16 extend outwardly and downwardly from the edges of the top plate 14 to the edges of the bottom plate 12. In addition, the rear plate is larger than the front plate; thus, the mounting plates 16 extend outwardly and rearwards from the front plate to the rear plate. Three spaced elongated screws 161 extend outwardly from each of the mounting plates 16 to be engaged with the LED lamps 20. A pair of through holes 163 (only one shown) is defined in the mounting plates 16. A driving circuit module 30 is received in the receiving member 10 to electronically connect with and supply power to the LED lamps 20. Electric wires (not shown) extend from the driving circuit board 30 through the through holes 163 to enter the LED lamps 20. A switch 40 is received in the receiving member 10 and electronically connects with the driving circuit board 30.

Each LED lamp 20 comprises a plurality of LED modules 21, a heat sink 23 supporting and cooling the LED modules 21, a plurality of reflectors 25 over the LED modules 21, and a housing 27 mounted around a periphery of the heat sink 23 to enclose the LED modules 21 and the reflectors 25 therein.

Figure 3:
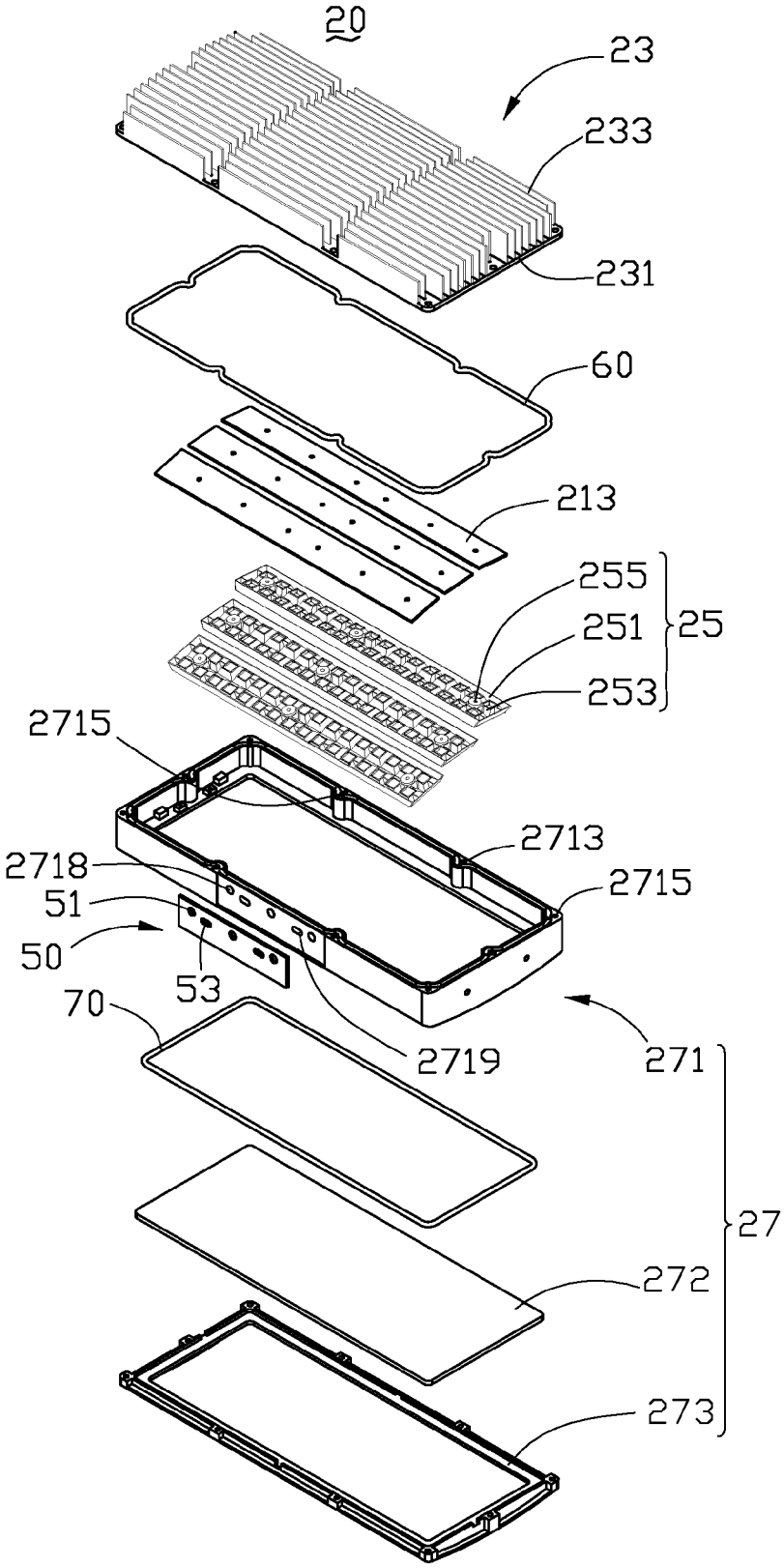
FIG. 3 is an exploded view of an LED lamp of FIG. 2.
Figure 4:
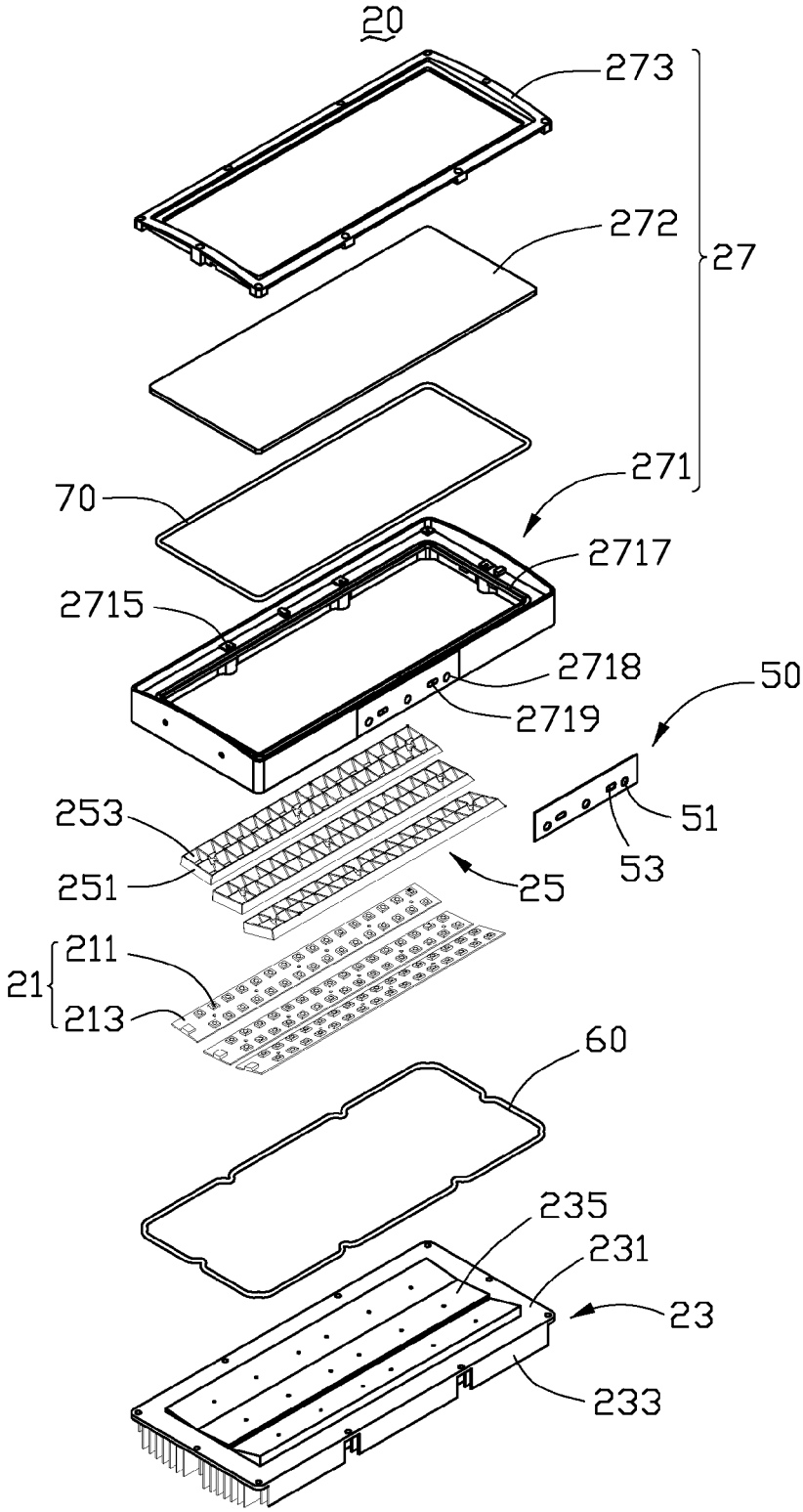
FIG. 4 is an inverted view of FIG. 3.

Referring to FIGS. 3-4, the heat sink 23 is made of a metal with a high degree of heat conductivity, such as copper or aluminum. The heat sink 23 comprises a rectangular base 231 and a plurality of fins 233 extending from the base 231. The base 231 comprises a top plate (not labeled) and a bottom plate (not labeled) opposite to the top plate. The fins 233 extend from the top plate of the base 231. A centre of the bottom plate of the base 231 protrudes three elongated planar surfaces 235. The LED modules 21 are attached on the surfaces 235. The surfaces 235 are angled with each other.

Each LED module 21 comprises an elongated printed circuit board 213 and a plurality of spaced LEDs 211 evenly mounted on a side of the printed circuit board 213. The LEDs 211 of each LED module 21 are arranged along a longitudinal direction of the printed circuit board 213. Each LED module 21 is mounted in a thermally conductive relationship with the bottom plate of the heat sink 23 and electronically connects with the driving circuit module 30.

Each reflector 25 is located over the printed circuit board 213 of a corresponding LED module 21. The reflector 25 comprises a rim 251 and a plurality of ribs (not labeled) within the rim 251. The rim 251 and the ribs connect with each other to define a plurality of through holes 253. The LEDs 211 are received in the through holes 253, respectively. Light generated by the LEDs 211 is reflected by the reflectors 25 to increase the intensity of the light emitted from the LED lamps 20. A plurality of sleeves 255 is formed in the reflector 25 along a thickness direction thereof. A plurality of screws (not shown) are used to extend through the sleeves 255 and the printed circuit boards 213 to threadedly engage with the heat sink 23 thereby to mount the reflectors 25 and the LED modules 21 on the heat sinks 23.

The housing 27 comprises a rectangular frame 271 engaging with the heat sink 23, a transparent cover 272 enclosed in the frame 271 and covering a bottom opening (not labeled) of the frame 271, and a rectangular fixture 273 located at a bottom of the frame 271 and mounting the cover 272 on the frame 271.

The frame 271 forms a plurality of protruding portions 2713 on inner surfaces thereof. Each protruding portion 2713 and each corner of the frame 271 define a screw hole 2715 therein. Screws (not shown) extend through the heat sink 23 and engage into a top portion of the screw holes 2715 to mount the frame 271 on the heat sink 23. The LED modules 21 are enclosed in the frame 271. A rectangular ring-shaped gasket 60 is sandwiched between the frame 271 and the heat sink 23 to enhance hermeticity of the connection between the frame 271 and the heat sink 23. A plurality of connecting plates (not labeled) extends inwardly from bottom of the inner surfaces of the frame 271. A plurality of supporting plates 2717 extends inwardly and downwardly from edges of the connecting plates to support the cover 272. The fixture 273 presses the cover 272 against the supporting plates 2717. Screws (not shown) extend through the fixture 273 and engage into a bottom portion of the screw holes 2715 to mount the fixture 273 on the frame 271. A rectangular ring-shaped gasket 70 is sandwiched between the cover 273 and the supporting plates 2717 to enhance hermeticity of the connection between the cover 273 and the supporting plates 2717. A centre of an elongated sidewall (not labeled) of the frame 271 defines three holes 2718 corresponding to the elongated screws 161 of the receiving member 10. A nut 2716 is received in each of the holes 2718 to engage with a corresponding one of the elongated screws 161. Two through holes 2719 are defined between the holes 2718 for extension of the electric wires from the driving circuit module 30 into the LED lamp 20.

A rectangular linking plate 50 is sandwiched between the elongated sidewall of the LED lamp 20 and the mounting plate 16 of the receiving member 10. The linking plate 50 defines three mounting holes 51 corresponding to the holes 2718 of the frame 271 of the LED lamp 20, and two holes 53 corresponding to the through holes 2719 of the frame 271 of the LED lamp 20. The elongated screws 161 extend through the mounting holes 51 of the linking plates 50, O-rings 55, 57 to threadedly engage with the nuts 2716 in the holes 2718 of the frame 271, thereby to mount the LED lamps 20 on the opposite sides of the receiving member 10. In this state, the heat sinks 23 extend outwardly and upwardly from the mounting plates 16 of the receiving member 10, as shown in FIG. 1. By the provision of the mounting plates 16 which are titled outwardly along top-to-bottom direction and tilted outwardly along front-to-rear direction, and the provision of the differently-angled planar surfaces 235 at the bottom the of the heat sinks 23, the LED modules 21 are oriented toward a plurality of different directions, whereby the LED lamp assembly in accordance with the present invention can have a large illumination angle. In addition, since the LED modules 21 have an intimate contact with the heat sinks 23, the heat generated by the LEDs 211 can be timely dissipated to surrounding air by the fins 233 of the heat sinks 23. Thus, the LED lamp assembly can work normally when the LEDs 211 are activated.

Figure 5:
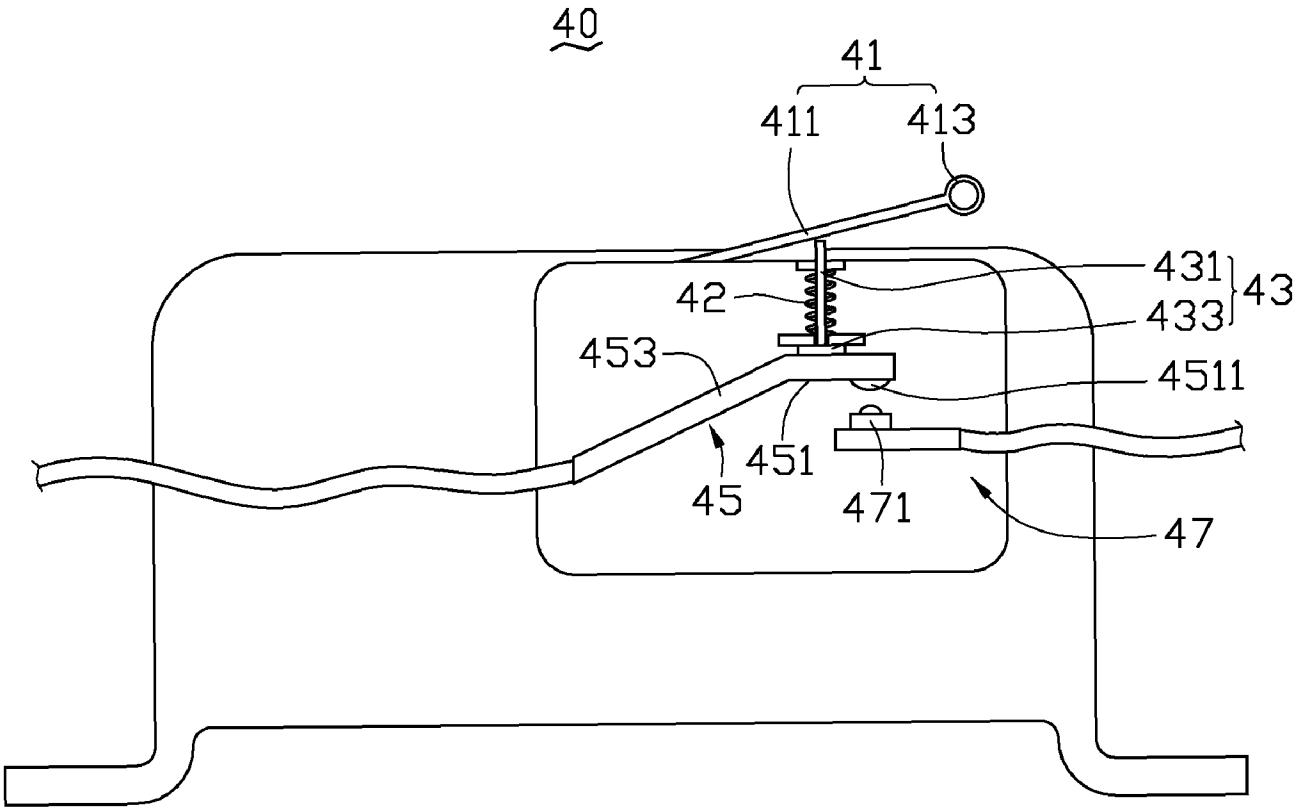
FIG. 5 is a schematic view of a switch of FIG. 2, wherein the switch is at an opened position.
Figure 6:
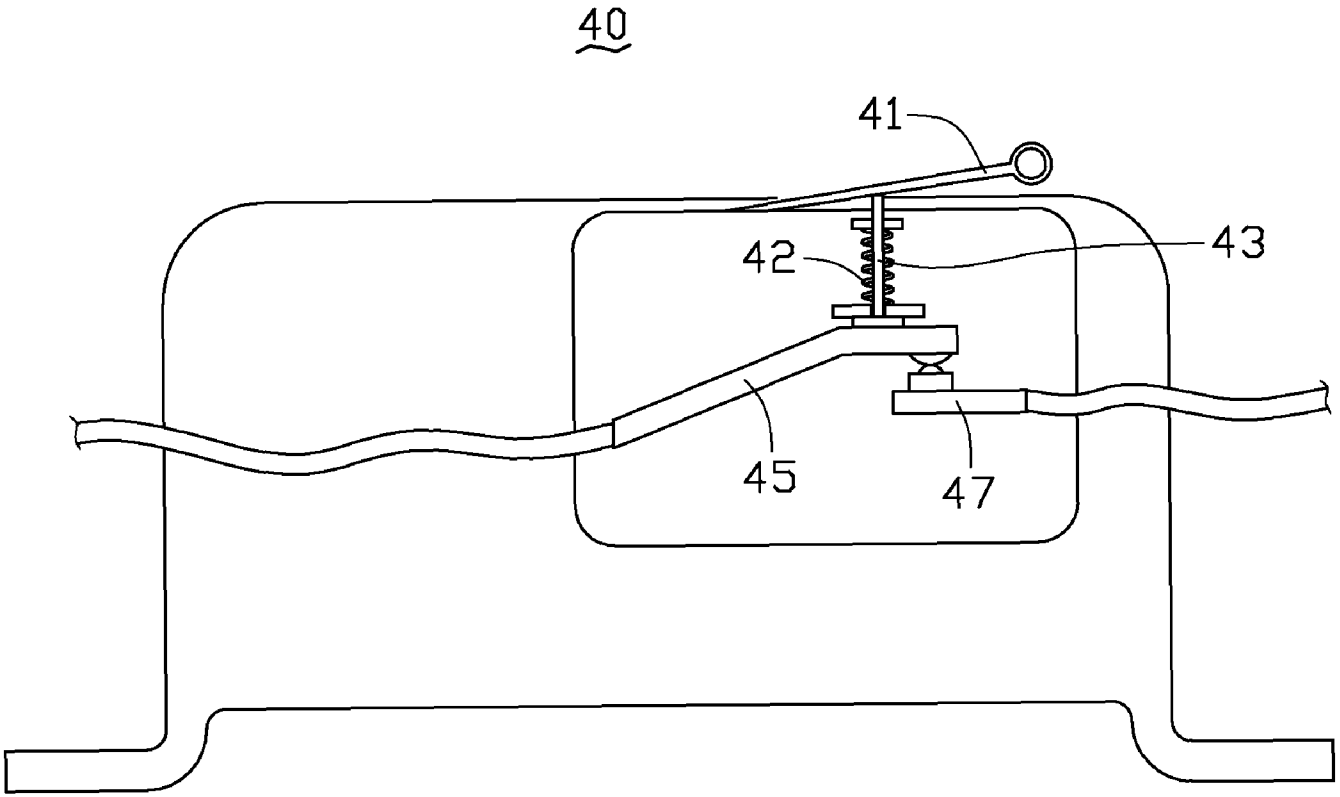
FIG. 6 is a schematic view of a switch of FIG. 2, wherein the switch is at a closed position.

Referring to FIGS. 5-6, the switch 40 is received in the receiving member 10 and mounted on the top plate 14. The switch 40 has a rectangular configuration. The switch 40 comprises two groups of parallel control members (not labeled). Each group of control member comprises an operating member 41 extending downwardly from a bottom portion of the switch 40, a first spring sheet 45 located at a top of the operating portion 41, a second spring sheet 47 located at a top of the first spring sheet 45, and a connecting member 43 secured to the first spring sheet 45 and sandwiched between the operating member 41 and the first spring sheet 45. The first spring sheet 45 of one group of control member electronically connects with the driving circuit module 30, and the corresponding second spring sheet 47 connects with one of positive and negative poles (not shown) of a power source (not shown). The first spring sheet 45 of another group of control member electronically connects with the driving circuit module 30, and the corresponding second spring sheet 47 thereof connects with another one of the positive and negative poles (not shown) of the power source. When the operating member 41 is pressed upwardly, the first spring sheet 45 is moved upwardly through an action of the connecting member 43 to make the first spring sheet 45 contact with the second spring sheet 47.

Each operating member 41 comprises an elongated pressing plate 411 extending slantwise, outwardly and downwardly from the bottom of the switch 40 and a pellet 413 located at an outmost end of the pressing plate 411. The connecting member 43 comprises a connecting pole 431 and a pressing block 433 perpendicular to the connecting pole 431. A spring 42 surrounds the connecting pole 431 and is compressed between the pressing block 433 and a washer (not labeled) fixed to the connecting pole 431 at a position near the bottom of the switch 40. The first spring sheet 45 comprises a supporting portion 451 to which the pressing block 433 of the connecting member 43 is securely attached and a connecting portion 453 electronically connecting with the driving circuit module 30. A protruding point 4511 extends upwardly from a top surface of the supporting portion 451 of the first spring sheet 45. A supporting point 471 extends downwardly from a bottom surface of the second spring sheet 47 to connect with the protruding point 4511 of the first spring sheet 45 when the operating member 41 is depressed by the bottom plate 12 of the receiving member 10.

Referring to FIG. 6 again, when the LED lamp works normally, the pressing plates 411 of the operating members 41 press the connecting poles 431 due to the bottom plate 12 of the receiving member 10 depressing the pellets 413 of the operating members 41. The pressing blocks 433 of the connecting members 43 press the supporting portions 451 of the first spring sheets 45. The protruding points 4511 of the supporting portions 451 connect with the supporting points 471 of the second spring sheets 47. The switch 40 is closed ("ON") so that current can flow from the power source through the switch 40, the driving circuit module 30 to the LEDs 211 of the LED modules 21. Accordingly, the LEDs 211 are driven to lighten Referring to FIG. 5 again, when the LED lamp needs to be repaired or maintained, the bottom plate 12 of the receiving member 10 is taken away and the operating members 41 are moved from the depressed position of FIG. 6 to the undepressed position of FIG. 5. In this undepressed position, the first spring sheets 45 are spaced from and no longer electrical connected with the second spring sheets 47. In this state, the switch 40 is opened ("OFF"). The current from the power source can no longer flow to the driving circuit module 30 and the LEDs 211 of the LED modules 21, whereby the serviceman can securely proceed with the repair and maintenance of the outdoor LED lamp assembly in accordance with the present invention. When the repair or maintenance of the outdoor LED lamp assembly is completed, the bottom plate 12 is mounted back on the receiving member 10, whereby the operating members 41 are depressed and the switch 40 is closed ("ON") again; thus, the current from the power source can flow to the LEDs 211 of the LED modules 21 to enable the LEDs 211 to lighten, and the serviceman can readily check the effectiveness of the repair or maintenance.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An outdoor LED lamp assembly comprising:

a receiving member comprising a bottom plate;

a driving circuit module received in the receiving member;

an LED lamp mounted on the receiving member, the LED lamp comprising a heat sink and a plurality of LED modules mounted on the heat sink; and a switch received in the receiving member and electronically connecting with the driving circuit module to control power off and power on of the outdoor LED lamp assembly, wherein the switch is "ON" when the bottom plate is mounted to the receiving member and the switch is "OFF" when the bottom plate is removed from the receiving member.

2. The outdoor LED lamp assembly as claimed in claim 1, wherein the switch comprises two groups of control members, each group of the control members comprising an operating member extending outwardly and downwardly from a bottom of the switch, a first spring sheet located at a top of the operating member and electronically connecting with the driving circuit module, and a second spring sheet located at a top of the first spring sheet adapted to electronically connect with a pole of a power source, the first and second spring sheets being electronically connected each other when the operating member is depressed by the bottom plate toward the first spring sheet, the first and second spring sheets being separated from each other when the bottom plate is removed from the operating member.

3. The outdoor LED lamp assembly as claimed in claim 2, wherein each group of the control members further comprises a connecting member sandwiched between the operating member and the first spring sheet; the connecting member is pressed by the operating member such that the first and second spring sheets are electrically connected each other when the bottom plate depresses the operating member.

4. The outdoor LED lamp assembly as claimed in claim 3, wherein the operating member comprises a pressing plate and a pellet located at an outmost end of the pressing plate, and the connecting member comprises a connecting pole and a pressing block connecting with the connecting pole, wherein the pressing plate presses the connecting pole when the bottom plate of the receiving member depresses the pellet of the operating member to make the first spring sheet move towards and electrically connect with the second spring sheet.

5. The outdoor LED lamp assembly as claimed in claim 4, wherein a spring surrounds the connecting pole of the connecting member and is compressed by the pressing block of the connecting member.

6. The outdoor LED lamp assembly as claimed in claim 5, wherein the first spring sheet comprises a supporting portion corresponding to the pressing block of the connecting member and a connecting portion electronically connecting with the driving circuit module, and a protruding point extending upwardly from a top surface of the supporting portion to contact with the second spring sheet.

7. The outdoor LED lamp assembly as claimed in claim 6, wherein a supporting point extends downwardly from the second spring sheet to connect with the protruding point of the first spring sheet.

8. The outdoor LED lamp assembly as claimed in claim 1, wherein the receiving member has a triangular configuration and consists of a top plate opposite to the bottom plate, and the bottom plate and the top plate are trapeziform and parallel to each other, and the bottom plate is large than the top plate, the switch being mounted on a top plate of the receiving member.

9. The outdoor LED lamp assembly as claimed in claim 8, a pair of slope plates extend outwardly and downwardly from edges of the top plate to edges of the bottom plate and the LED lamp extend slantwise and upwardly from one of the slope plates.

10. The outdoor LED lamp assembly as claimed in claim 1, wherein the heat sink comprises a base, the base comprising a bottom plate, a centre of the bottom plate of the base being protruded into a plurality of elongated planar surfaces which are angled with each other and the LED modules are attached on the elongated planar surfaces, respectively.

11. The outdoor LED lamp assembly as claimed in claim 10, wherein the LED lamp comprises a plurality of reflectors over the LED modules, respectively, the reflectors being secured to the heat sink.

12. The outdoor LED lamp assembly as claimed in claim 11, wherein a housing engages with a bottom portion of the heat sink to enclose the LED modules and the reflectors therein.

13. The outdoor LED lamp assembly as claimed in claim 12, wherein the housing comprises a rectangular frame engaging with the heat sink, a transparent cover enclosed in the frame and covering an opening of the frame, and a rectangular fixture located at a bottom of the frame and mounting the cover on the frame.

14. The LED lamp assembly as claimed in claim 13, wherein a pair of gaskets are respectively sandwiched between the heat sink and the frame and between the frame and the cover.

15. An LED lamp assembly comprising:

a receiving member having a top plate, a bottom plate and a pair of mounting plates extending outwardly and downwardly from the top plate to the bottom plate;

a pair of LED lamps mounted on the mounting plates of the receiving member, respectively;

a driving circuit module received in the receiving member and electrically connecting with the LED lamps; and a switch received in the receiving member and electrically connecting with the driving circuit module, wherein the switch is "ON" when the bottom plate of the receiving member is mounted on the receiving member and is "OFF" when the bottom plate is removed from the receiving member.

16. The LED lamp assembly as claimed in 15, wherein the switch has an operating member, a first spring sheet and a second spring sheet, the operating member being depressed by the bottom plate and the first spring sheet electrically connecting with the second spring sheet when the bottom plate is mounted on the receiving member.

* * * * *